US011504759B2

(12) United States Patent
Miftari et al.

(10) Patent No.: US 11,504,759 B2
(45) Date of Patent: Nov. 22, 2022

(54) STAMPING DIES AND GUIDED RETAINER DEVICES FOR USE IN SAME

(71) Applicant: Anchor Lamina America, Inc., Dayton, OH (US)

(72) Inventors: Gezim Miftari, Flatrock, MI (US); Jon Raymond Hartman, Rives Junction, MI (US); Jeffrey William Ouimet, Rochester Hills, MI (US); Kevin John Latouf, Windsor (CA)

(73) Assignee: Anchor Lamina America, Inc., Dayton, OH (US)

( * ) Notice: Subject to any disclaimer, the term of this patent is extended or adjusted under 35 U.S.C. 154(b) by 0 days.

(21) Appl. No.: 16/931,804

(22) Filed: Jul. 17, 2020

(65) Prior Publication Data

US 2021/0023604 A1 Jan. 28, 2021

Related U.S. Application Data

(60) Provisional application No. 62/876,855, filed on Jul. 22, 2019.

(51) Int. Cl.
*B21D 37/12* (2006.01)
*B21D 22/02* (2006.01)

(52) U.S. Cl.
CPC ..... *B21D 37/12* (2013.01); *B21D 22/02* (2013.01)

(58) Field of Classification Search
CPC ..... B21D 37/00; B21D 37/02; B21D 37/10; B21D 37/12; B21D 22/02; B21D 22/06
USPC ..... 72/343, 344, 446, 455, 456
See application file for complete search history.

(56) References Cited

U.S. PATENT DOCUMENTS 5,503,860 A 4/1996 Donnelly et al.
5,716,658 A 2/1998 Donnelly et al.
6,848,290 B2 2/2005 Pyper et al.
7,024,910 B2 4/2006 Pyper et al.
(Continued)

FOREIGN PATENT DOCUMENTS

WO 2011159677 A2 12/2011
WO 2012033824 A2 3/2012
(Continued)

OTHER PUBLICATIONS

European Patent Office, Extended Search Report and Written Opinion issued in EP 20187287.6 dated Oct. 29, 2020.

*Primary Examiner* — Adam J Eiseman
*Assistant Examiner* — Fred C Hammers
(74) *Attorney, Agent, or Firm* — Wood Herron & Evans LLP

(57) ABSTRACT

A guided retainer for movably coupling a holder to a plate of a stamping die for use in a press including a pin having an enlarged portion. A bushing received on and slidable relative to the pin into an abutting relationship with the enlarged portion. When the guided retainer is assembled with the holder and the plate, the guided retainer is capable of transferring motion of the holder to the plate during movement of the press to an opened position for insertion of a workpiece into the stamping die. The pin includes a groove and a retainer plate that is received in the groove. A stamping die configured to be used in a press to modify a workpiece. The stamping die including a holder that is adapted to be coupled to the press. A plate that is spaced apart from the holder and a guided retainer.

22 Claims, 7 Drawing Sheets

(56) References Cited

U.S. PATENT DOCUMENTS

| | | | | |
|---|---|---|---|---|
| 7,730,757 | B2 | 6/2010 | Pyper et al. | |
| 7,739,871 | B2 | 6/2010 | Cotter et al. | |
| 7,861,569 | B2 | 1/2011 | Cotter et al. | |
| 7,870,832 | B2 | 1/2011 | Cotter | |
| 7,950,262 | B2 | 5/2011 | Pyper et al. | |
| 8,074,486 | B1 | 12/2011 | Pyper et al. | |
| 8,146,399 | B2 | 4/2012 | Pyper et al. | |
| 8,151,619 | B2 | 4/2012 | Pyper et al. | |
| 8,348,249 | B2 | 1/2013 | Cotter | |
| 8,444,122 | B2 | 5/2013 | Cotter et al. | |
| 8,490,763 | B2 | 7/2013 | Vandine | |
| 8,522,595 | B2 | 9/2013 | Pyper et al. | |
| 8,567,227 | B2 | 10/2013 | Cotter | |
| 8,616,038 | B2 | 12/2013 | Breen et al. | |
| 8,733,147 | B2 | 5/2014 | Breen et al. | |
| 8,746,029 | B2 | 6/2014 | Breen et al. | |
| 8,844,335 | B2 | 9/2014 | Pyper et al. | |
| 8,910,502 | B2 * | 12/2014 | Breen | B21D 37/04 72/344 |
| 8,919,178 | B2 | 12/2014 | Breen et al. | |
| 8,939,005 | B2 | 1/2015 | Breen et al. | |
| 8,950,233 | B2 | 2/2015 | Pyper et al. | |
| 8,955,364 | B2 | 2/2015 | Breen et al. | |
| 9,010,169 | B2 | 4/2015 | Breen et al. | |
| 9,046,146 | B2 | 6/2015 | Cotter | |
| 9,067,253 | B2 | 6/2015 | Pyper et al. | |
| 9,138,799 | B2 | 9/2015 | Breen et al. | |
| 9,144,864 | B2 | 9/2015 | Cotter | |
| 9,221,092 | B2 | 12/2015 | Pyper et al. | |
| 9,248,491 | B2 | 2/2016 | Breen et al. | |
| 9,254,515 | B2 | 2/2016 | Breen et al. | |
| 9,259,809 | B2 | 2/2016 | Pyper et al. | |
| 9,272,321 | B2 | 3/2016 | Breen et al. | |
| 9,289,815 | B2 | 3/2016 | Breen et al. | |
| 9,302,311 | B2 | 4/2016 | Pyper et al. | |
| 9,347,510 | B2 | 5/2016 | Cotter | |
| 9,375,777 | B2 | 6/2016 | Breen et al. | |
| 9,381,560 | B2 | 7/2016 | Pyper et al. | |
| 9,416,840 | B2 | 8/2016 | Vandine | |
| 9,447,834 | B2 | 9/2016 | Cotter | |
| 9,551,394 | B2 | 1/2017 | Cotter | |
| 9,694,411 | B2 | 7/2017 | Breen et al. | |
| 9,737,923 | B2 | 8/2017 | Preen et al. | |
| 9,776,233 | B2 | 10/2017 | Breen et al. | |
| 9,895,740 | B2 | 2/2018 | Breen et al. | |
| 10,035,180 | B2 | 7/2018 | Breen et al. | |
| 10,046,376 | B2 | 8/2018 | Breen et al. | |
| 10,099,270 | B2 | 10/2018 | Pyper et al. | |
| 10,113,605 | B2 | 10/2018 | Cotter | |
| 10,265,757 | B2 | 4/2019 | Pyper et al. | |
| 10,343,205 | B2 | 7/2019 | Breen et al. | |
| 10,343,206 | B2 | 7/2019 | Breen et al. | |
| 10,384,259 | B2 | 8/2019 | Breen et al. | |
| 10,406,585 | B2 | 9/2019 | Pyper et al. | |
| 10,527,121 | B2 | 1/2020 | Softer | |
| 10,639,701 | B2 | 5/2020 | Breen et al. | |
| 10,730,099 | B2 | 8/2020 | Breen et al. | |
| 10,864,610 | B2 | 12/2020 | Wichmann et al. | |
| 10,954,984 | B2 | 3/2021 | Breen et al. | |
| 10,962,030 | B1 | 3/2021 | VanderWeide | |
| 2014/0191451 | A1 | 7/2014 | Moss | |
| 2014/0191452 | A1 | 7/2014 | Moss | |
| 2014/0304991 | A1 * | 10/2014 | Lin | B21D 22/02 29/897.3 |
| 2015/0076753 | A1 | 3/2015 | Cotter | |
| 2019/0210086 | A1 | 7/2019 | Pyper et al. | |
| 2020/0122220 | A1 | 4/2020 | Breen et al. | |
| 2020/0206800 | A1 | 7/2020 | Breen et al. | |
| 2020/0254503 | A1 | 8/2020 | Breen et al. | |
| 2020/0282444 | A1 | 9/2020 | Breen et al. | |
| 2020/0300329 | A1 | 9/2020 | Cotter | |
| 2021/0018106 | A1 | 1/2021 | Gretka, II | |
| 2021/0033133 | A1 | 2/2021 | Breen et al. | |
| 2021/0033134 | A1 | 2/2021 | Breen et al. | |
| 2021/0069769 | A1 | 3/2021 | Preen et al. | |
| 2021/0101200 | A1 | 4/2021 | Breen et al. | |

FOREIGN PATENT DOCUMENTS

| | | | | |
|---|---|---|---|---|
| WO | 2012115901 | A2 | 8/2012 | |
| WO | WO-2012115901 | A2 * | 8/2012 | B23P 15/24 |

* cited by examiner

STAMPING DIES AND GUIDED RETAINER DEVICES FOR USE IN SAME

CROSS REFERENCE TO RELATED APPLICATION

This application claims priority to U.S. Application No. 62/876,855 filed on Jul. 22, 2019, and which is incorporated by reference herein in its entirety.

TECHNICAL FIELD

The present invention relates generally to stamping dies and, more particularly, to devices for use during metal stamping and other like processes.

BACKGROUND

A stamping die is a precision tool that cuts and forms metal into a predetermined shape. Most stamping dies are an assembly of several components including die plates, punches, holders, guide pins, retainers, and bushings, to name a few. Typically, a top plate or punch holder and a lower plate or die holder are assembled together with guide pins and bushings. The punch holder and die holder are movable relative to one another along the guide pins to process a part positioned between the punch holder and the die holder. Additional plates, for example backing plates, punch plates, and die plates, and tools are located between the punch holder and the die holder and are designed to form or cut a part during each cycle of the stamping die.

As an example, a punch may be secured to the punch holder via a punch plate and a corresponding die may be secured to the die holder via a die plate. The punch in cooperation with the corresponding die operates to cut or to pierce a part during a stamping cycle. To that end, the stamping die is inserted into a punch press. The punch press applies forces ranging from a few tons to more than 1,000 tons to the stamping die. The press thus causes the punch holder and the die holder to move toward one another to forcibly engage the punch and the die with a part in between the two. A part positioned in a working space between them is perforated by the punch and/or is formed.

Additional components of a stamping die may include a pressure pad. The pressure pad may be movably carried by the punch holder with guide pins and bushings and retainers. During a cycle of the stamping die, the pressure pad moves relative to each of the punch holder and die holder, though the pressure pad is movably carried by the punch holder. The pressure pad is a pressure-loaded plate, either flat or contoured. Pressure pads apply a force to the part via high-pressure coils or gas springs. The pressure pad holds, controls, or strips the part from the tool (e.g., a punch) during a cutting and forming processes.

By way of additional example, a stripper pad or plate or both is a flat or contoured spring-loaded plates/pads that strip the metal off a tool (e.g., a punch). To do so, the stripper is carried by the punch holder and surrounds the punch. During each cycle of the stamping die, as the punch exits the die, the stripper holds the part against the die. The punch is then pulled away from the part while the stripper holds the part in place. Similar to a pressure pad, the stripper is carried by the punch holder by retainers and guide pins.

While there are many types of stamping dies that are designed to perform different cutting and forming operations, one type is a progressive die. Progressive dies provide an effective way to convert raw coil stock or blank into finished parts with minimal handling. The stock is advanced from station to station in the die during each cycle of the press. In this way, the part is progressively worked from an initial stock configuration at the first station into a final part at the last station. The part is moved one station at a time during each press cycle. For example, an initial station may perforate holes with one or more punches. These holes then serve as pilots to locate the part during operations in later stations which may form and cut the part.

One problem encountered with stamping dies is alignment of all components of the die. Alignment is critical for quality part production and longevity of the stamping die. As the punch holder and die holder cycle during production, their relative axial and rotational movement must be precisely controlled. Similarly, movement of the pressure pads and strippers relative to the part and the punch holder must be precisely controlled. To obtain proper alignment, guide pins must be precise and their orientation in the punch holder and die holder is critical. Misalignment, even slight misalignment, between any of the components of the die may damage the part and/or the die due to the extreme loads transmitted to the die and part. The size of the stamping die further complicates the alignment of all components. This is particularly true of progressive dies.

While stamping dies have been commercially successful, there exists a need for stamping dies and devices that improve stamping die performance while easing assembly and reducing costs.

SUMMARY

The present invention overcomes the foregoing and other shortcomings and drawbacks of stamping dies and pins heretofore known for use in manufacturing presses. While the invention will be described in connection with certain embodiments, it will be understood that the invention is not limited to these embodiments.

In accordance with the principles of the present invention, a guided retainer is for movably coupling a holder to a plate of a stamping die. The stamping die is then usable in a press to modify a workpiece, such as a sheet of metal. The guided retainer comprises a pin that has a first end and a second end. The first end has an enlarged portion separated from the second end by an offset. A bushing is received on and is slidable relative to the pin into an abutting relationship with the offset. When the guided retainer is assembled with the holder and the plate, the guided retainer is capable of transferring motion of the holder to the plate during movement of the press to an opened position for insertion of a workpiece into the stamping die.

In one embodiment, the pin includes a groove in a circumference of the pin proximate the second end. In one embodiment, the guided retainer includes a retainer plate that is received in the groove, the retainer plate being configured to receive a fastener for coupling the retainer plate to the plate. In one embodiment, the retainer plate comprises a pair of plates that are received in the groove. In one embodiment, the pin defines a longitudinal axis from the first end to the second end and a radius and wherein the retainer plate includes a through-bore located at a distance from the longitudinal axis that is greater than the radius.

In one embodiment, the guided retainer further includes a clamp that is received on and is slidable relative to the pin. The clamp is configured to receive a fastener for coupling the clamp to the holder, and when the clamp is coupled to the holder, the clamp fixes the bushing in fixed position relative to the holder.

In one embodiment, the pin does not include penetrations for receiving a fastener for attachment of the pin to the holder or to the plate.

In one embodiment, the guided retainer further includes a bumper between the offset and the bushing. In one embodiment, the pin is monolithic.

According to one aspect, there is a stamping die for use in a press. The stamping die comprises a holder, a plate, and one embodiment of the guided retainer described herein. The guided retainer is fixedly attached to the plate and movably attached to the holder.

According to one aspect, there is a stamping die configured to be used in a press to modify a workpiece, and the stamping die comprises a holder that is adapted to be coupled to the press. A plate is spaced apart from the holder and is configured to contact the workpiece. A guided retainer has a pin that defines a first end opposite a second end. The first end has an enlarged portion separated from the second end by an offset. The guided retainer movably couples the holder to the plate with the guided retainer being fixedly attached to the plate proximate the first end and movably attached to the holder. The guided retainer transfers motion of the holder to the plate during movement of the press to an opened position for insertion of a workpiece into the stamping die.

In one embodiment, the pin extends through each of the holder and the plate. The guided retainer is fixedly attached to the plate at a location that does not include direct attachment of the plate to the pin.

In one embodiment, the plate includes a through-bore and the first end is received in the through-bore.

In one embodiment, the pin defines a longitudinal axis from the first end to the second end and defines a radius. The guided retainer is fixedly attached to the plate at a location that is spaced apart from the longitudinal axis by a distance that is greater than the radius.

In one embodiment, a retainer plate projects outwardly from the pin proximate the first end, and the guided retainer is fixedly attached to the plate via one or more fasteners through the retainer plate and into the plate.

In one embodiment, the pin includes a groove opening outwardly proximate the first end and the retainer plate is received in the groove.

In one embodiment, the plate includes a through-bore and a counter bore that communicates with the through-bore, and the pin is received in the through-bore and the retainer plate is received in the counter bore.

In one embodiment, the guided retainer includes a bushing that slidably engages the pin and is fixed relative to the holder.

In one embodiment, the enlarged portion of the pin is configured to stop movement of the pin relative to the bushing in one direction.

In one embodiment, the bushing has an inside diameter that is configured to slidably engage the pin, and the enlarged portion is larger than the inside diameter of the bushing.

In one embodiment, the guided retainer includes a clamp that is secured to the holder via one or more fasteners and fixes the bushing to the holder.

In one embodiment, the guided retainer includes a bumper between the enlarged portion and the holder.

In one embodiment, the guided retainer couples the holder to the plate without a guide pin or a retainer.

In one embodiment, the pin includes a groove in a circumference of the pin proximate the second end, and the guided retainer further includes a retainer plate that is received in the groove. The retainer plate is configured to receive a fastener for coupling the retainer plate to the plate. The guided retainer further includes a bushing that is received on and is slidable relative to the pin into an abutting relationship with the offset. The guided retainer further includes a clamp that is received on and is slidable relative to the pin, the clamp being configured to receive a fastener for coupling the clamp to the holder, and when the clamp is coupled to the holder, the clamp fixes the bushing in fixed position relative to the holder.

BRIEF DESCRIPTION OF THE DRAWINGS

The accompanying drawings, which are incorporated in and constitute a part of this specification, illustrate embodiments of the invention and together with the detailed description given below, serve to explain various aspects of the invention.

DETAILED DESCRIPTION

Figure 1:
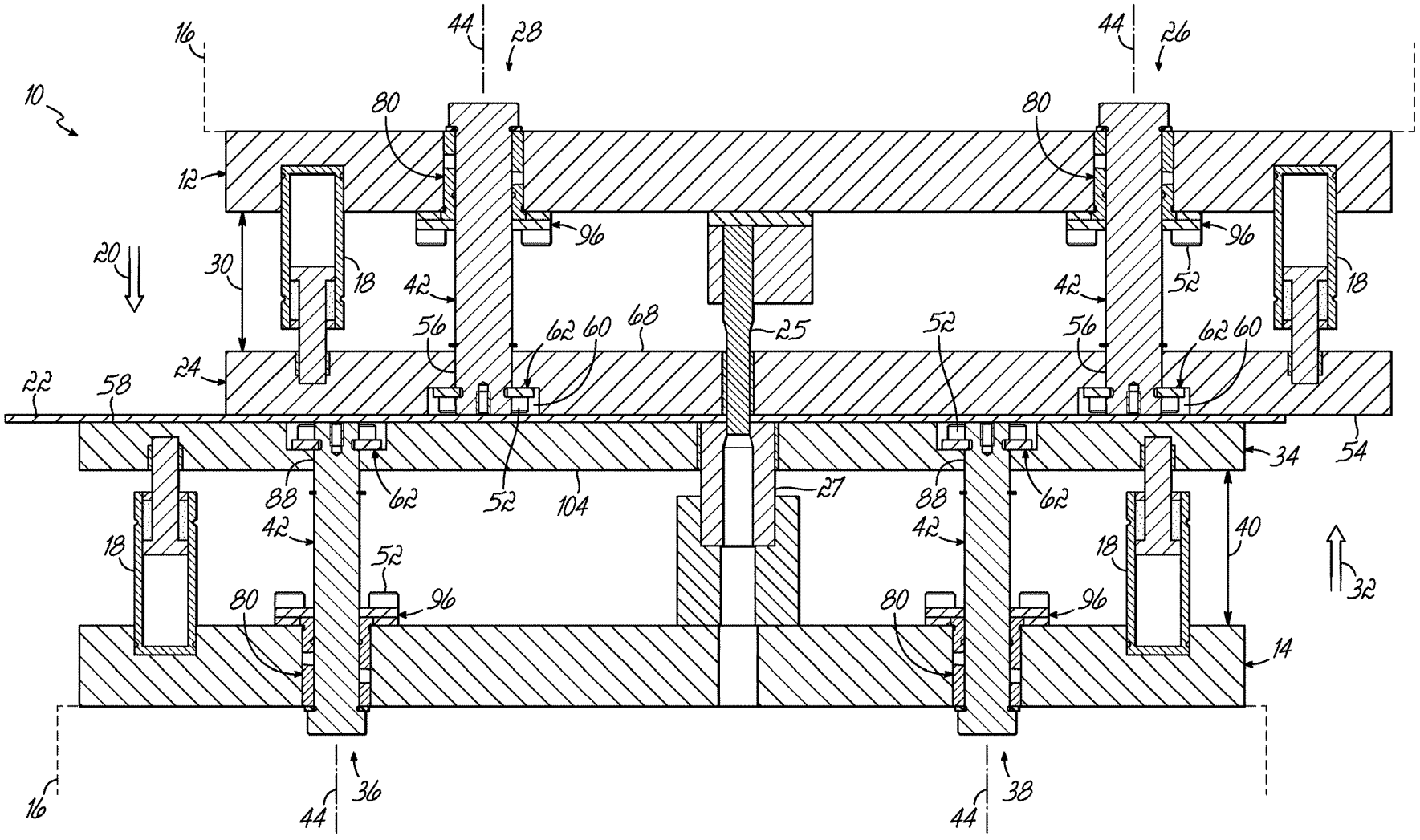
FIG. 1 is a cross-sectional elevation view of a stamping die and a workpiece according to one embodiment of the invention.

With reference to FIG. 1, in an exemplary embodiment of the invention, a stamping die 10 includes a punch holder 12 in opposing relation to a die holder 14. The punch holder 12 may be aligned with the die holder 14 with one or more guide pins 18. In the embodiment shown, guide pins 18 may be gas springs. The stamping die 10 is insertable into a press 16 (shown in phantom line). During use of the stamping die 10 via operation of the press 16, the punch holder 12 is forcibly moved relative to the die holder 14 in accordance with arrow 20. By this movement, a workpiece 22 is captured and worked on by the stamping die 10. For example, in a metal cutting operation, the stamping die 10 may include a punch 25 with a punch retainer and retainer backing plate (not labeled) secured to the punch holder 12. A die button 27 with a die button retainer (not labeled) may be mounted to the die holder 14. Compression of the punch holder 12 drives the punch 25 through the workpiece 22 into the die button 27 thereby cutting the workpiece 22, as shown. The stamping die 10 is not limited to cutting operations as the stamping die 10 may be configured to produce other modifications (e.g., forming) of the workpiece 22.

In the exemplary embodiment shown, a pressure plate or pressure pad 24 is movably coupled to the punch holder 12 by two guided retainers 26 and 28. Although two guided retainers 26 and 28 are shown, embodiments of the invention are not limited to use of two guided retainers. There may be a single guided retainer 26 or 28 or more than two guided retainers 26 and 28, the number of guided retainers being determined based on the size, weight, or stripping pressure of the stamping die 10. In general, as any one of these increases, the number of guided retainers may increase.

The guided retainers 26, 28 have multiple functions during use of the stamping die 10. In general, for example, during a cycle of the stamping die 10, the pressure pad 24 contacts and presses against the workpiece 22. This movement causes a punch, for example, to pierce the workpiece 22. According to movement along arrow 20, the pressure pad 24 contacts the workpiece 22. The punch holder 12 then moves relative to the pressure pad 24. This movement reduces a gap 30 during which the movement of the punch holder 12 relative to the pressure pad 24 is defined by each of the guided retainers 26 and 28. In the embodiment shown, the movement is perpendicular to the workpiece 22. As the press 16 reaches its fully extended position, which corresponds to the fully compressed configuration of the stamping die 10, the press 16 cycles to withdraw the punch and the pressure pad 24 from the workpiece 22. During reverse movement of the press 16, the guided retainers 26 and 28 guide and retain the pressure pad 24 relative to the punch holder 12 while the stamping die 10 is compressed. Once the stamping die 10 withdraws the punch holder 12 to a certain distance, the guided retainers 26 and 28 transfer continued upward motion (in the direction of arrow 32) of the holder 12 to the pressure pad 24 so that the pad 24 no longer contacts the workpiece 22.

With continued reference to FIG. 1, in the exemplary embodiment, the stamping die 10 includes a lifter plate 34. The lifter plate 34 is movably coupled to the die holder 14 by two guided retainers 36 and 38. And, while two guided retainers 36 and 38 are shown, embodiments of the invention are not limited to two guided retainers. Guided retainers 36 and 38 operate in substantially the same way as the guided retainers 26 and 28, however, they do not lift the lifter plate 34 upon separation of the holders 12 and 14. Rather, the guided retainers 36 and 38 guide and limit movement of the lifter plate 34 under the force of springs (springs are not shown in the figures). In that case, the guided retainers 36 and 38 may prevent full extension of the springs. To that end, during movement of the press 16 according to arrow 20, the lifter plate 34 is compressed toward the die holder 14. A gap 40 between the lifter plate 34 and the die holder 14 is reduced. Movement of the lifter plate 34 toward the die holder 14 is guided and aligned by each of the guided retainers 36 and 38. And, as the press 16 cycles in the direction of arrow 32, springs (not shown) force the lifter plate 34 in the same direction (i.e., in the direction of arrow 32). In this way, the lifter plate 34 may lift the workpiece 22 from a die secured to the die holder 14. Workpiece 22 is aligned in the stamping die 10 relative to punch holder 12 and the pressure pad 24 usually by means of guided rails and/or locating pins (not shown).

According to embodiments of the invention, guided retainers 26 and 28 and 36 and 38 may be used in the absence of guide pins or retainer pins (guide pins 18 are shown in phantom line in FIG. 6) to movably couple the pressure pad 24 and the punch holder 12 and the lifter plate 34 and the die holder 14, as those devices are known in the art. Advantageously, the guided retainers 26, 28, 36, and 38 occupy much less space in the stamping die 10. Although not shown in FIG. 1, the punch holder 12 is movably coupled to the die holder 14 via guide pins and bushings.

So, during compression by the press 16, each of gaps 30 and 40 is initially reduced as the overall distance between the punch holder 12 and the die holder 14 is reduced. This produces relative movement of the pressure pad 24 and the lifter plate 34. The guided retainers 26, 28, 36, and 38 guide that movement. During the opposite movement of the press 16 according to the arrow 32, the guided retainers 26, 28, 36, and 38 guide the reverse movement while retaining the pressure pad 24 and the lifter plate 34 secured to the punch holder 12 and die holder 14, respectively. The movement of the guided retainer during this movement is shown in detail in FIGS. 4 and 5, which are described below. Advantageously, the guided retainers 26, 28, 36, and 38 serve a dual purpose in that each guides relative movement of the respective holder 12, 14 and plate 24, 34 pairs while maintaining parallel relationship between pairs of holder 12, 14 and plate 24, 34 and also retains the corresponding components (e.g., punch and die) in precise operable relation to one another during each cycle of the press 16.

Figure 2:
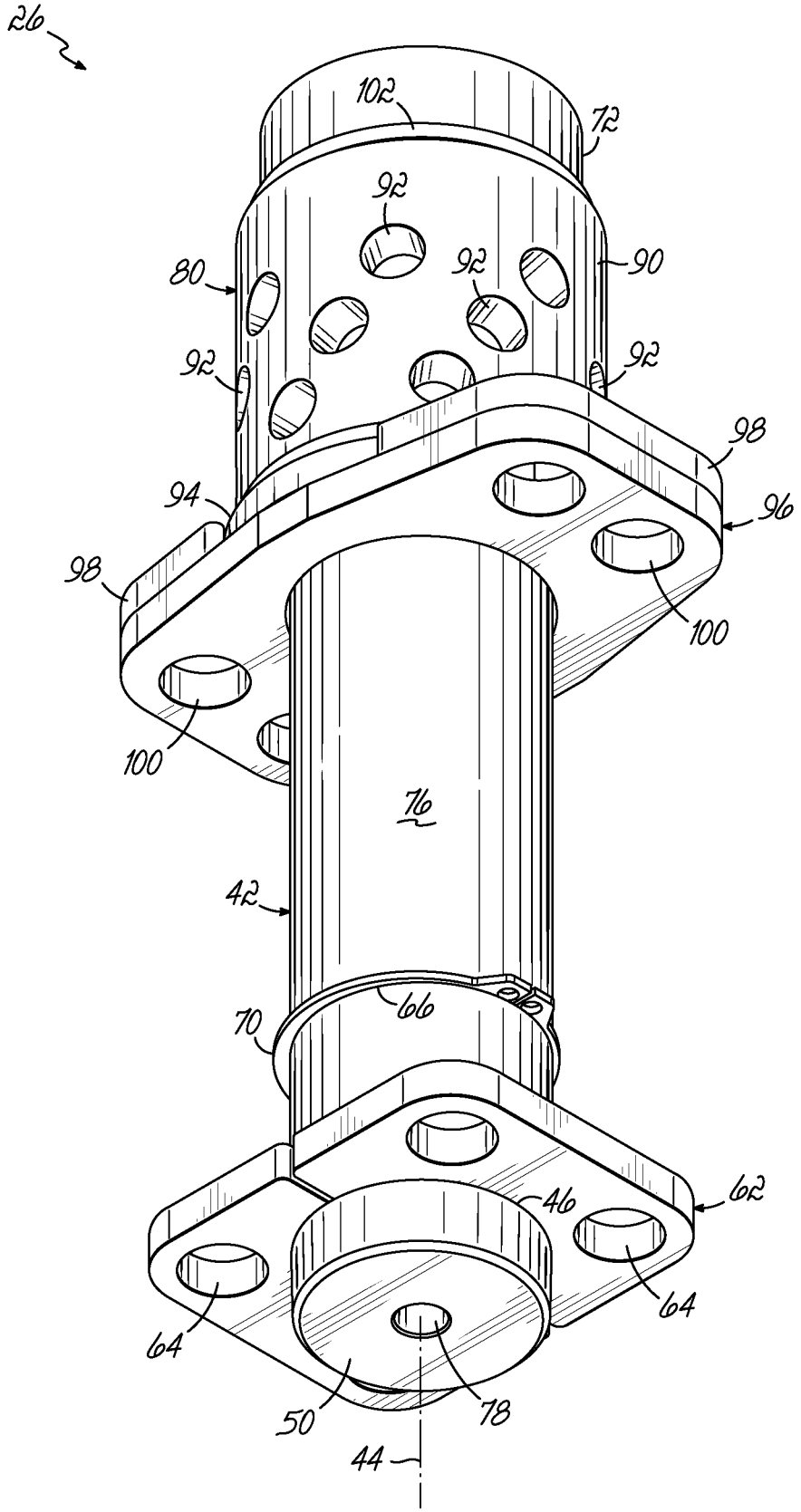
FIG. 2 is a perspective view of a guided retainer according to one embodiment of the invention.
Figure 3:
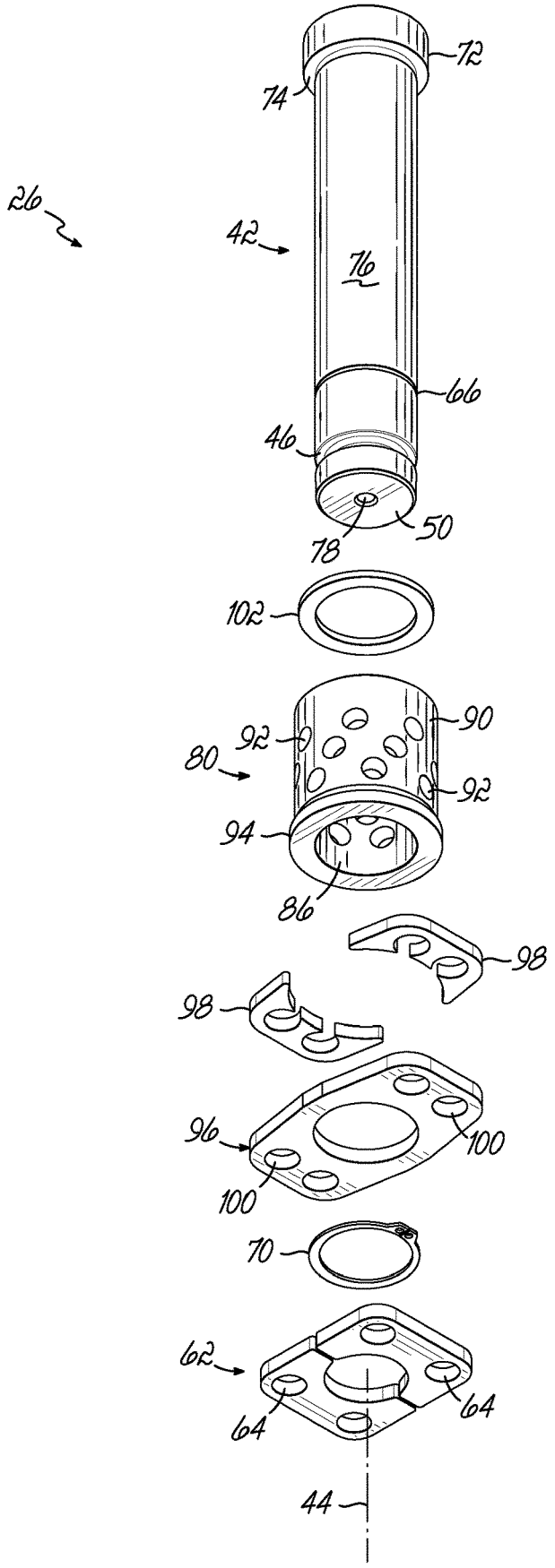
FIG. 3 is an exploded perspective view of the guided retainer of FIG. 2.

With reference to FIGS. 2 and 3, an exemplary embodiment of a guided retainer 26 is shown. Each of guided retainers 28, 36, and 38 are similar to the guided retainer 26 and may vary in relative size. As shown, the guided retainer 26 includes a pin 42 that defines a longitudinal axis 44 of the guided retainer 26. The axis 44 also defines a direction of movement according to arrows 20 and 32 of FIG. 1 for relative movement between the punch holder 12 and the pressure pad 24 and between the die holder 14 and the lifter plate 34. Although a punch holder is described in reference to the guided retainer, embodiments of the invention are not limited to use of the guided retainer with either of a lifter plate or a punch holder. Other plates may be secured between a punch holder or top plate and a die holder or bottom plate in a stamping die. Embodiments of the invention are not limited to any particular bottom, top, or intervening plate.

The pin 42 has a groove 46 (FIG. 3) adjacent one end 50. The groove 46 may run along a partial or a complete circumference of the pin 42. The groove 46 opens outwardly in a direction generally radially from the longitudinal axis 44 and receives a pair of flange-like retainer plates 62 which project outwardly from the surface of the pin 42. One or more through-bores 64 in the retainer plates 62 receive a socket head cap screw 52 (shown in FIGS. 1 and 4). The guided retainer 26 is secured to the pressure pad 24 or the lifter plate 34 via the cap screws 52 through the retainer plate 62. While socket head cap screws 52 are shown and described, other fasteners may be used to fixedly secure the retainer plate 62 to the pad 24 or plate 34. Embodiments of the invention are not limited to any particular type of fastener.

Figure 5:
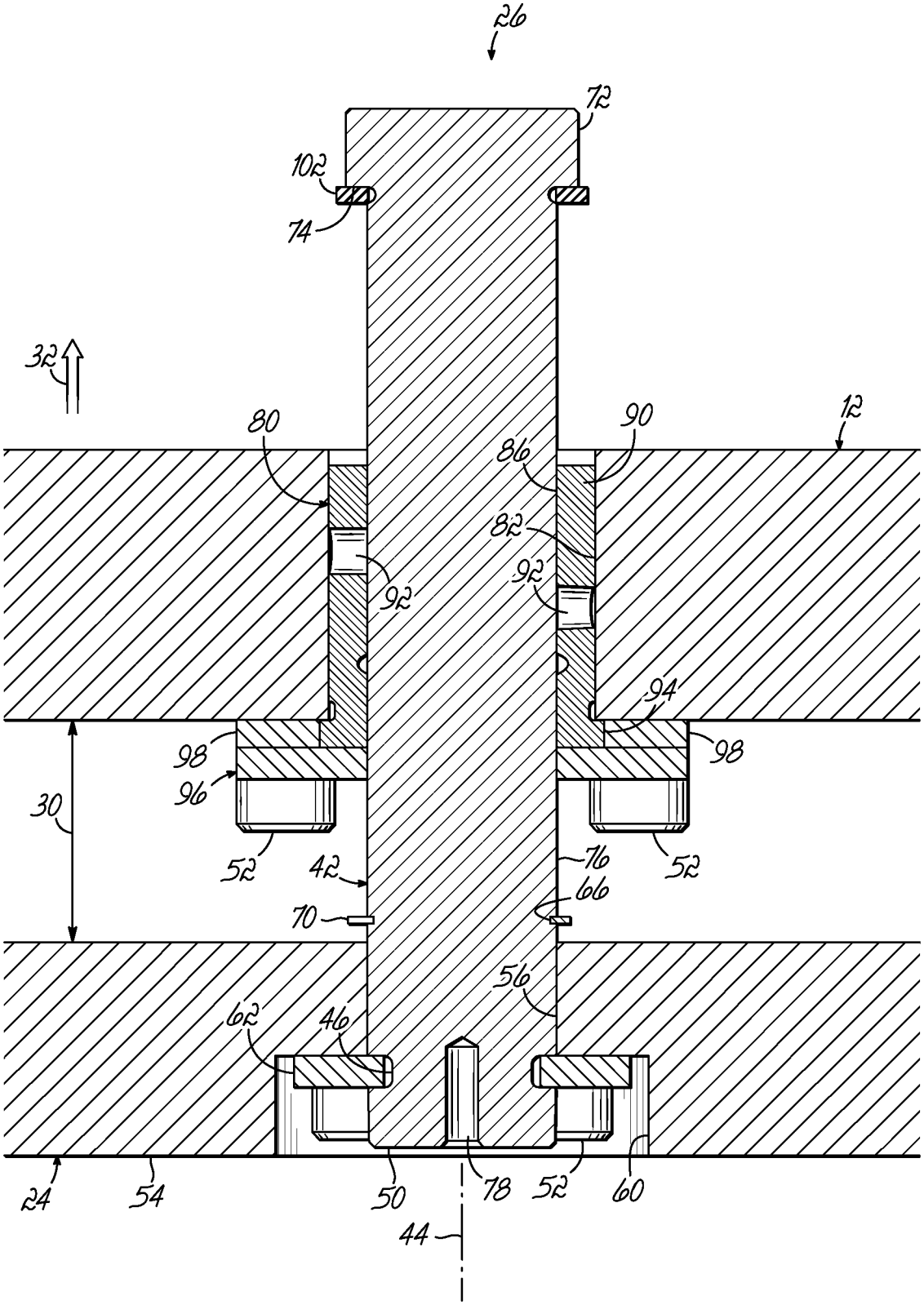
FIG. 5 is a cross-sectional view of the guided retainer of FIG. 2 in a different relative configuration.

As is shown in FIGS. 1 and 5, to that end, the socket head cap screws 52 attach the guided retainer 26 to the respective pressure pad 24 or lifter plate 34 via the retainer plate 62. The pressure pad 24 includes a bore 56 extending from the working surface 54 to an opposing surface 68. The pin 42 is inserted into and may extend through the bore 56. A similar configuration may exist with the lifter plate 34 in which a bore 88 extends from the working surface 58 to an opposing surface 104 of the lifter plate 34. The pin 42 of the guided retainer 36, 38 extends into and possibly through the lifter plate 34.

In one embodiment, the pressure pad 24 includes a counter bore 60 that communicates with the bore 56. In the exemplary embodiment, the counter bore 60 is symmetrically positioned with respect to the bore 56. In this arrangement, the counter bore 60 is sized to receive the retainer plates 62. As is shown best in FIG. 5, the spacing between the groove 46 and the end 50 is at least the height of the head of the socket head cap screw 52 and thickness of the retainer plates 62. This permits the end 50 to be slightly recessed (e.g., 0.010 inches to 0.020 inches) below a working surface 54 of the pressure pad 24. Although not shown, the end 50 of the pin 42 may be flush with the working surface 54. A similar construction of the lifter plate 34 is also contemplated and is shown in FIG. 1 in which the end 50 of the pin 42 is recessed below or flush with the working surface 58 of the lifter plate 34. Embodiments of the invention are not limited to a flush or recessed position of the pin 42 relative to the working surface 54, 58 of either the pressure plate 24 or the lifter plate 34.

Figure 4:
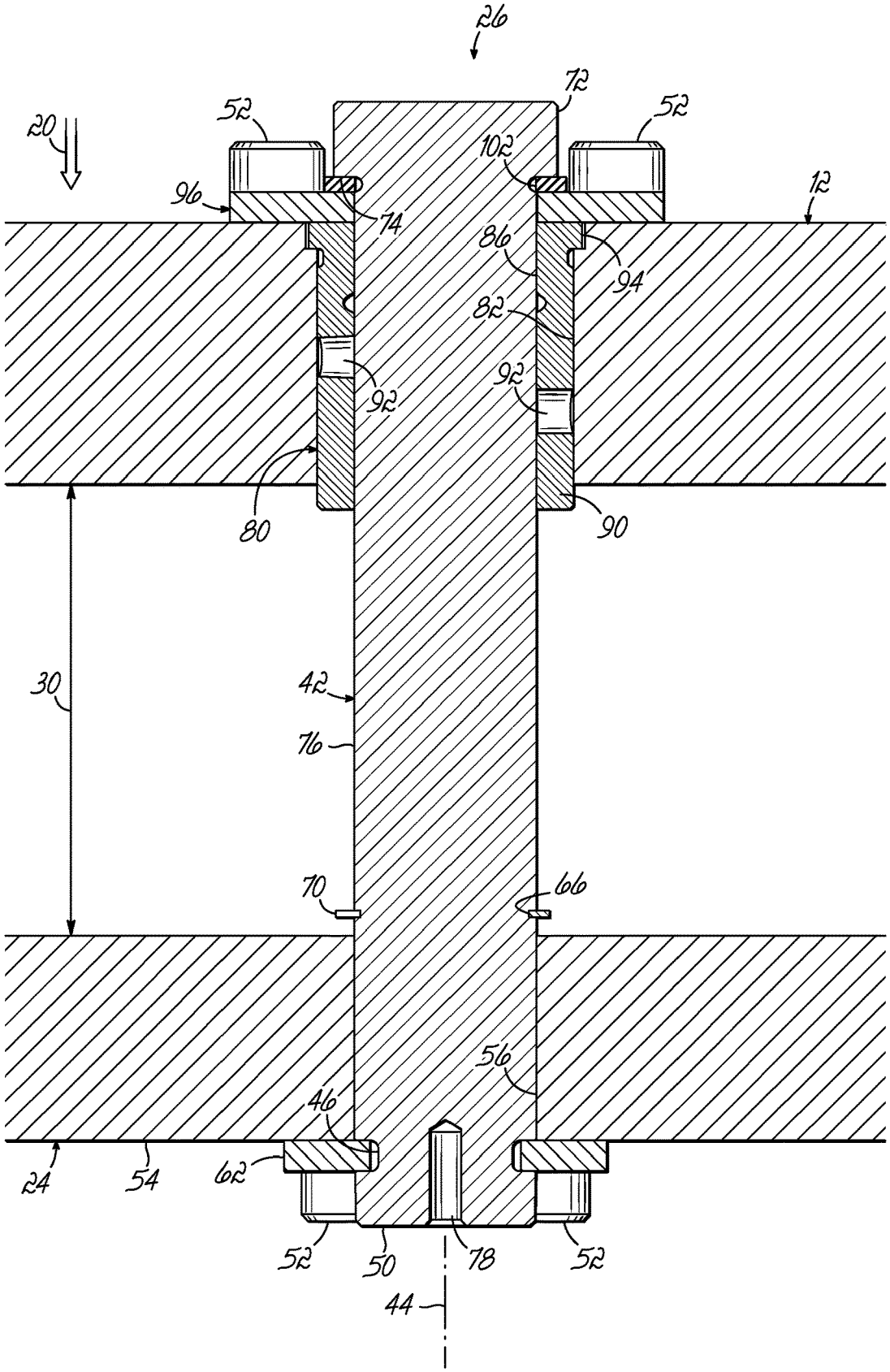
FIG. 4 is a cross-sectional view of the guided retainer shown in FIG. 2.

In that regard, for example and with reference to FIG. 4, the end 50 of the pin 42 may extend beyond the working surface 54 with the retainer plates 62 being fixedly secured to the working surface 54 via the socket head cap screws 52. No counter bore 60 in the bore 56 is required. Thus, the guided retainer 26 may be face mounted to the pressure pad 24 and/or the lifter plate 34 depending upon the setup of the stamping die 10. In either embodiment shown in FIGS. 4 and 5, the points of connection between the guided retainer 26 and the plate 24 or 34 are at a location spaced apart from the pin 42. In each embodiment, the pin 42 is not directly attached to the pressure pad 24 or the lifter plate 34 with a fastener. That is, as shown, the end 50 of the pin 42 does not receive a fastener. Instead, the screws 52 secure the end 50 of the guided retainer 26 to the pressure plate 24 or lifter plate 34 via the retainer plate 62 and groove 46 arrangement. The axis of the screws 52 at the locations of attachment to the pad 24 and to the lifter plate 34 are at a distance from the axis 44 that is greater than the radius of the pin 42. Advantageously, this arrangement (i.e., the lack of securing the pin 42 directly to a plate) improves the strength at the connection between the guided retainer 26 and the pressure pad 24 or the lifter plate 34.

Referring to FIGS. 2 and 3, the pin 42 further includes a second narrower groove 66 that receives a snap ring 70 or similar member. The snap ring 70 extends outwardly of the pin 42. The snap ring 70 retains the pin 42 in the punch holder 12 or in the die holder 14 during assembly and disassembly with the pressure pad 24 or lifter plate 34, respectively, described below with reference to FIGS. 6 and 7. Further with regard to assembly and disassembly, the pin 42 may define a tapped hole 78 in the end 50 to receive a threaded rod 106 (shown in FIGS. 6 and 7) to ease insertion of the pin 42 into the bore 56 of plate 24 or into a similar bore 88 in plate 34. However, the tapped hole 78 is not utilized to secure the pin 42 to the pressure pad 24 or to lifter plate 34. In the exemplary embodiment, the pin 42 does not include any other penetrations in either end 50, 72.

Referring to FIG. 3, the other end 72 of the pin 42 is oversized relative to the end 50 to form an offset 74. To form an enlarged portion at end 72 (e.g., shown as an oversized end 72), a solid bar is machined to form a reduced diameter along a majority of a length of the pin 42 leaving the end 72 oversized and forming the offset 74 between the oversized end 72 and a working end 76 of the pin 42. The offset 74 acts as a stop as described below. This construction advantageously improves strength of the pin 42 at the punch holder 12 because the pin 42 is monolithic.

As is shown in FIGS. 2 and 3, the guided retainer 26 incorporates a bushing 80 that is received within a bore 82 (shown best in FIGS. 4 and 5) in the punch holder 12 or die holder 14. In the exemplary embodiment, the bushing 80 is generally cylindrical with a circular cylindrical passage sized to slidably receive the pin 42. The inside diameter of the bushing 80 is sized to receive the outside diameter of the pin 42. The pin 42 is thus capable of sliding relative to the bushing 80 during use of the stamping die 10. To that end, the bushing 80 includes an inner passage 86 sized to receive the pin 42 along the working end 76. The inner passage 86 and outer surface of the bushing 80 define a wall 90 through which there is a plurality of through-bores 92. The through-bores 92 may be filled with a solid lubricant, such as graphite, or another lubricious material that aids in the self-lubrication of the bushing 80 during movement relative to the pin 42. One end 94 of the bushing 80 is oversized and thereby acts as a stop against the punch holder 12 when the stamping die 10 is assembled, as is shown best in FIGS. 4 and 5. The bushing 80 may be assembled in the punch holder 12 in one of two orientations and with or without a counter bore in the holder 12, described below. Although not shown, similar orientations of the bushing 80 are possible with the die holder 14.

With reference to FIGS. 2 and 3, to attach the guided retainer 26 to the punch holder 12, the guided retainer 26 includes a clamp 96 and optional spacer 98. Much like the retainer plates 62, the clamp 96 (without the spacer 98 is shown in FIG. 4 or with the spacer 98 is shown in FIG. 5) with screws 52 secure the guided retainer 26 to the punch holder 12. The clamp 96 includes one or more through-bores 100 to receive socket head cap screws 52 or other similar fasteners that are received in the punch holder 12 or die holder 14. The guided retainer 26 is secured to the plate 24, 34 proximate one end 50 and is movably secured to the holder 12, 14 near the end 72.

In one arrangement, shown in FIG. 4, the bushing 80 is oriented with the end 94 adjacent the oversized end 72 of the pin 42. As shown, the end 94 may reside in a counter bore (not labeled) in the punch holder 12. In this arrangement, the clamp 96 is flush mounted to the punch holder 12 in the absence of the spacer 98, and the bushing 80 may extend beyond the punch holder 12 at the location opposite the end 94. In another arrangement, shown in FIG. 5, the bushing 80 is oriented with the end 94 between the holder 12 and the plate 24, the spacer 98 is utilized between the punch holder 12 and the clamp 96, and the bushing 80 may be slightly recessed from a top surface of the punch holder 12. In either orientation of the bushing 80 shown in FIGS. 4 and 5, the bushing 80 may be flush on one or both ends with the punch holder 12 and is secured to the holder 12 via the clamp 96. The bushing 80 is, however, movable along the pin 42 between the oversized end 72 and the pressure pad 24. The oversized end 72 (and bumper 102, if present) providing a stop to relative movement of the holder 12 by an interference fit with the bushing 80. In essence, the guided retainer 26 is secured to each of the punch holder 12 and to the pressure pad 24, Once assembled, the clamp 96 captures the bushing 80 in the bore 82 of the respective punch holder 12 or die holder 14. In one embodiment, a bumper 102 is captured between the bushing 80 and the end 72. The bumper 102 softens the impact and reduces noise of contact between the end 72 and the bushing 80 during an opening movement of the stamping die 10.

During use of the stamping die 10, and with reference to FIGS. 4 and 5, as the press 16 cycles from an opened position in which a workpiece 22 is inserted between the punch holder 12 and the die holder 14 to a compressed position, the punch holder 12 is moved along axis 44 of the guided retainer 26. Once the pressure pad 24 contacts the workpiece 22, the guided retainer 26 guides the relative motion between the punch holder 12 and the pressure pad 24. During this relative motion, the pin 42 slides through the bushing 80 as the punch holder 12 moves toward the pressure pad 24 according to arrow 20. Once the punch holder 12 reaches its fully compressed position, as is generally shown in FIG. 5, the press 16 begins withdrawal of the punch holder 12.

Upon the reverse movement of the press 16 (according to arrow 32 in FIG. 5), the punch holder 12 reaches a location at which the offset 74 abuts or otherwise engages the bushing 80. At this position, continued movement of the press 16 according to arrow 32 retracts the punch holder 12 and with the offset 74 engaged with the punch holder 12 at the end 72 begins lifting the pressure pad 24 via the guided retainer 26 from contact with the workpiece 22.

Although not described, a similar motion occurs between the die holder 14 and the lifter plate 34 (shown in FIG. 1) during cycling of the press 16. The guided retainer 36 controls the relative motion between the holder 14 and the plate 34 by virtue of the axis 44 of the pin 42 and limits the travel of the lifter plate 34 away from the die holder 14 under a spring force by the contact between the offset 74 and the bushing 80.

Figure 6:
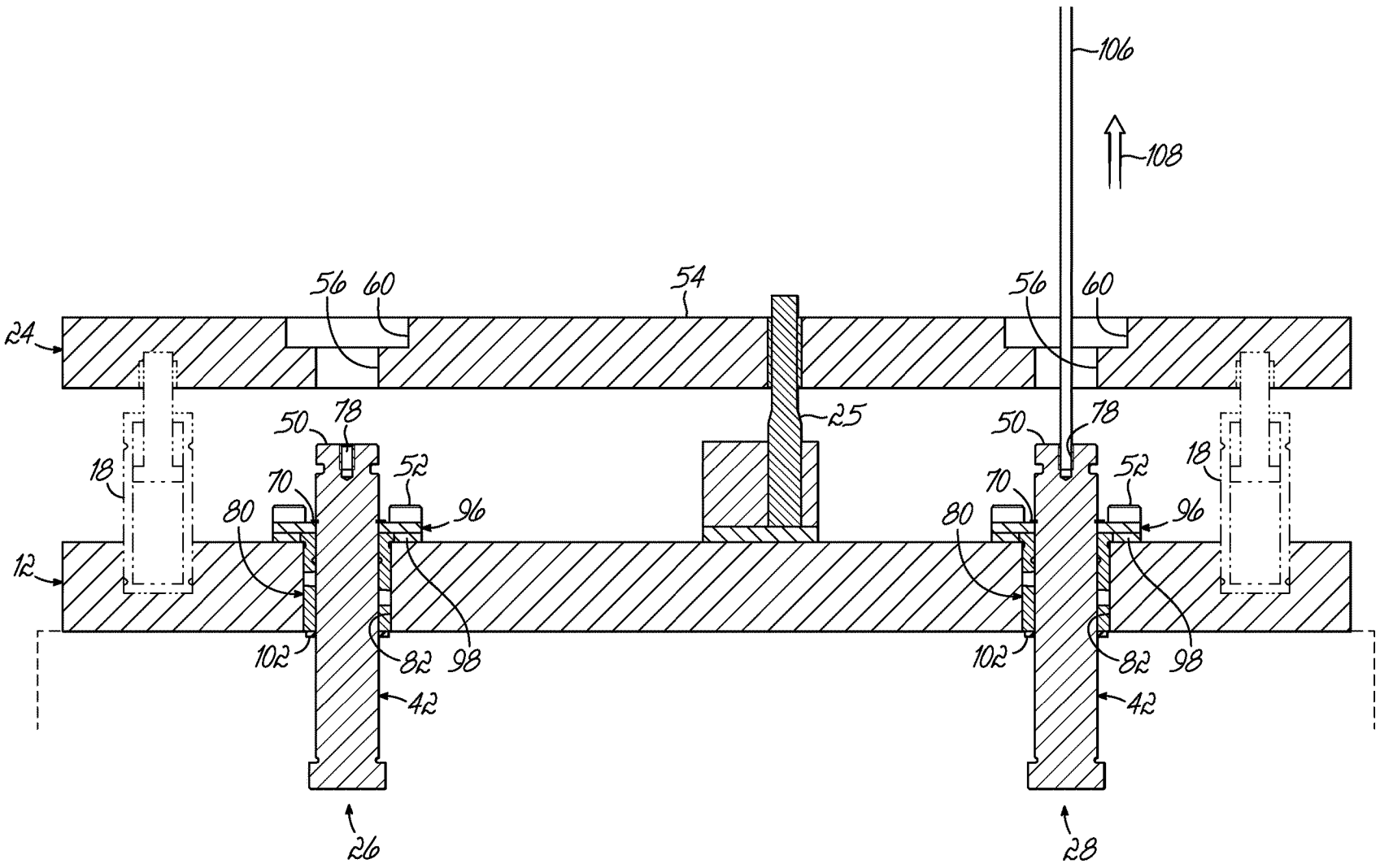
FIGS. 6 and 7 are cross-sectional elevation views of a portion of a stamping die illustrating assembly.
Figure 7:
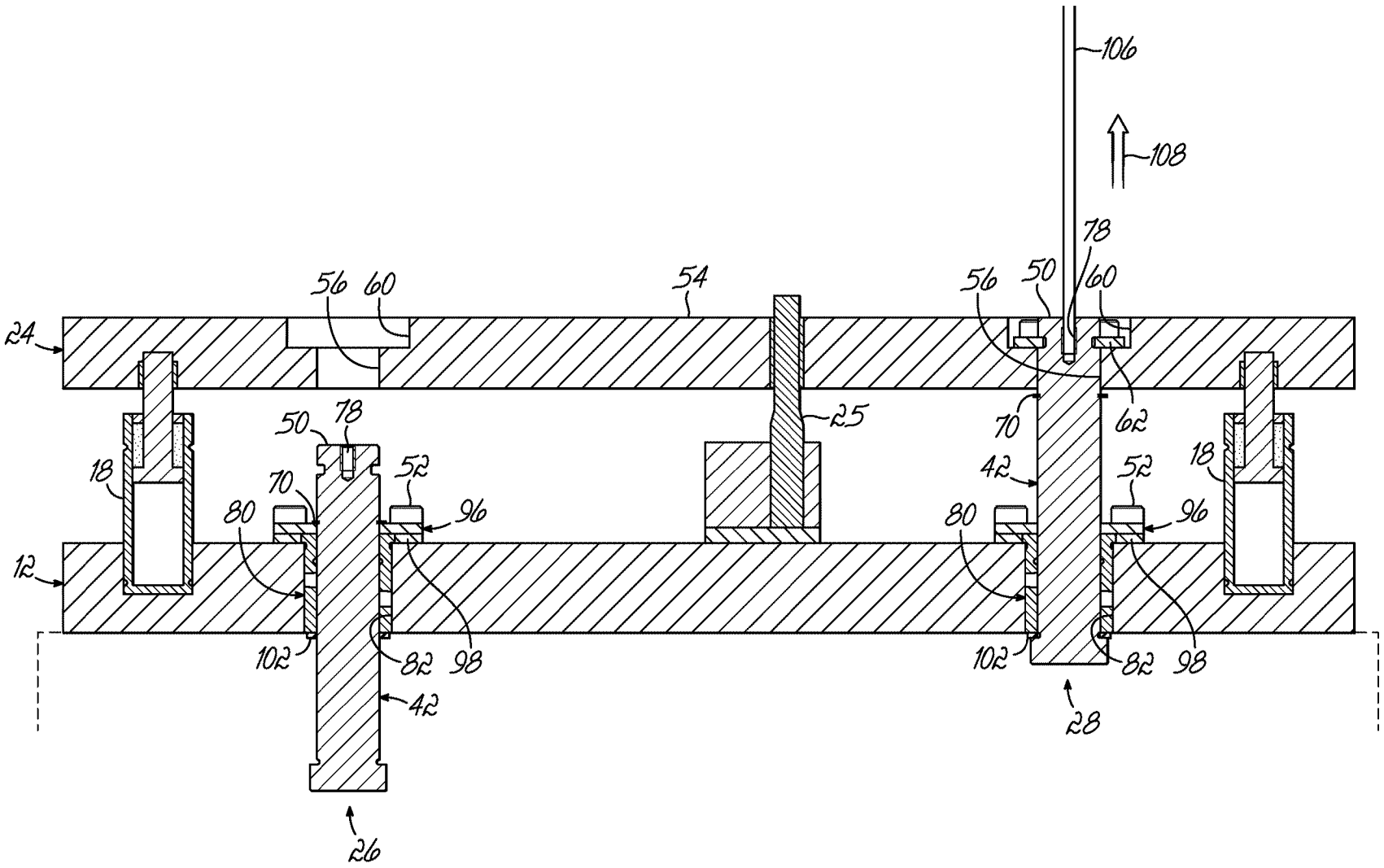

With reference to FIGS. 6 and 7, assembly of the punch holder 12 to the pressure pad 24 is shown. The punch holder 12 is shown upside down during the exemplary assembly process. Prior to placement of the pressure pad 24 in the position shown in FIG. 6, with the punch holder 12 in an upside-down orientation, the punch 25 and punch retainer (not labeled) are secured to the punch holder 12. Optional spacers 98, if used, are attached to the punch holder 12, and the guide pins 18 may also be secured to the punch holder 12. Next, the pin 42, bushing 80, bushing plate 96 (also referred to as a clamp), and bumper 102 are inserted into the punch holder 12. Screws 52 secure the plate 96 and optional bushing plate 98 to the punch holder 12 and thereby secure the bushing 80 in bore 82. The snap ring 70 in groove 66 retains the pin 42 in the position shown in FIG. 6. The pressure pad 24 is then oriented relative to the punch 25 and guide pins 18 and so opposes the punch holder 12. The punch 25 may extend through the pressure pad 24.

Next, the pin 42 is secured to the pressure pad 24. This is accomplished by inserting threaded rod 106 through bore 56 and threading it into the tapped hole 78. The pin 42 is then pulled through the bore 56 in the pressure pad 24 in the direction of arrow 108. The retainer plates 62 are engaged in groove 46, and the screws 52 secure the retainer plate 62 to the pressure pad 24. The rod 106 is unscrewed from the pin 42. Each guided retainer 26 and 28 is coupled to the punch holder 12 and pressure plate 24 in a similar manner. The assembled punch holder 12 and pressure plate 24 is insertable in the press 16 for use opposite the lifter plate 34 and die holder 14 (shown in FIG. 1). While not shown, assembly of the lifter plate 34 to the die holder 14 is accomplished in a similar manner. It will be appreciated that when the die holder 14 and lifter plate 34 are assembled, there is no need to flip the lifter plate 34 upside down.

While the present invention has been illustrated by a description of various embodiments and while these embodiments have been described in some detail, it is not the intention of the inventors to restrict or in any way limit the scope of the appended claims to such detail. Thus, additional advantages and modifications will readily appear to those of ordinary skill in the art. The various features of the invention may be used alone or in any combination depending on the needs and preferences of the user.

What is claimed is:

1. A guided retainer for movably coupling a holder to a plate of a stamping die for use in a press, the guided retainer comprising:

a pin that has a first end and a second end, the first end having an enlarged portion separated from the second end by an offset, wherein the pin includes a groove in a circumference of the pin proximate the second end;

a bushing that is received on and is slidable relative to the pin into an abutting relationship with the offset and a retainer plate that is directly received in the groove, the retainer plate being configured to receive a fastener, wherein when the guided retainer is assembled with the holder and the plate, the guided retainer is capable of transferring motion of the holder to the plate during movement of the press to an opened position for insertion of a workpiece into the stamping die.

2. The guided retainer of claim 1, wherein the retainer plate comprises a pair of plates that are received in the groove.

3. The guided retainer of claim 1, wherein the pin defines a longitudinal axis from the first end to the second end and a radius and wherein the retainer plate includes a through-bore located at a distance from the longitudinal axis that is greater than the radius.

4. The guided retainer of claim 1, further including a clamp that is received on and is slidable relative to the pin, the clamp being configured to receive a fastener for coupling the clamp to the holder or to the plate, and when the clamp is coupled to the holder or to the plate, the clamp fixes the bushing in fixed position relative to the holder or to the plate.

5. The guided retainer of claim 1, wherein the pin does not include penetrations for receiving a fastener for attachment of the pin to the holder or to the plate.

6. The guided retainer of claim 1, further including a bumper between the offset and the bushing.

7. The guided retainer of claim 1, wherein the pin is monolithic.

8. A stamping die for use in the press, the stamping die comprising a holder, a plate, and the guided retainer of claim 1 being fixedly attached to the plate and movably attached to the holder.

9. A stamping die configured to be used in a press to modify a workpiece, the stamping die comprising:

a holder that is adapted to be coupled to the press;

a plate that is spaced apart from the holder and is configured to contact the workpiece; and a guided retainer that has a pin, the pin defining a first end opposite a second end, the first end having an enlarged portion separated from the second end by an offset, wherein the pin includes a groove in a circumference of the pin proximate the second end, and the pin extending through each of the holder and the plate, and the guided retainer including a retainer plate that is directly received in the groove, and the guided retainer is fixedly attached to the holder or to the plate via one or more fasteners through the retainer plate and into the holder or into the plate, wherein the guided retainer movably couples the holder to the plate with the guided retainer being fixedly attached to the holder or to the plate proximate the first end and movably attached to the plate or to the holder at the second end, and the guided retainer transfers motion of the holder to the plate during movement of the press to an opened position for insertion of a workpiece into the stamping die.

10. The stamping die of claim 9, wherein the guided retainer is fixedly attached to the holder or to the plate at a location that does not include direct attachment of the holder or the plate to the pin.

11. The stamping die of claim 9, wherein the plate or the holder includes a through-bore and the second end is received in the through-bore.

12. The stamping die of claim 9, wherein the pin defines a longitudinal axis from the first end to the second end and defines a radius, and wherein the guided retainer is fixedly attached to the holder or to the plate at a location that is spaced apart from the longitudinal axis by a distance that is greater than the radius.

13. The stamping die of claim 9, wherein the retainer plate projects outwardly from the pin proximate the second end, and the guided retainer is fixedly attached to the holder or to the plate via one or more fasteners through the retainer plate and into the holder or into the plate.

14. The stamping die of claim 13, wherein the holder or the plate includes a through-bore and a counter bore that communicates with the through-bore, and wherein the pin is received in the through-bore and the retainer plate is received in the counter bore.

15. The stamping die of claim 9, wherein the guided retainer includes a bushing that slidably engages the pin and is fixed relative to the holder or to the plate.

16. The stamping die of claim 15, wherein the enlarged portion of the pin is configured to stop movement of the pin relative to the bushing in one direction.

17. The stamping die of claim 15, wherein the bushing has an inside diameter that is configured to slidably engage the pin, and the enlarged portion is larger than the inside diameter of the bushing.

18. The stamping die of claim 15, wherein the guided retainer includes a clamp that is secured to the holder or to the plate via one or more fasteners and fixes the bushing to the holder or to the plate.

19. The stamping die of claim 15, wherein the guided retainer includes a bumper between the enlarged portion and the holder or the plate.

20. The stamping die of claim 9, wherein the guided retainer couples the holder to the plate without a guide pin or a retainer pin.

21. The stamping die of claim 9, wherein the guided retainer further comprises:

a bushing that is received on and is slidable relative to the pin into an abutting relationship with the offset; and a clamp that is received on and is slidable relative to the pin, the clamp being configured to receive a fastener for coupling the clamp to the holder or to the plate, and when the clamp is coupled to the holder or to the plate, the clamp fixes the bushing in fixed position relative to the holder or to the plate.

22. A guided retainer for movably coupling a holder to a plate of a stamping die for use in a press, the guided retainer comprising:

a pin that has a first end and a second end, the first end having an enlarged portion separated from the second end by an offset, wherein the pin includes a groove in a circumference of the pin proximate the second end;

a bushing that is received on and is slidable relative to the pin into an abutting relationship with the offset; and a retainer plate that is received in the groove and projects outwardly from the pin, the retainer plate being configured to receive a fastener, wherein when the guided retainer is assembled with the holder and the plate, the guided retainer is capable of transferring motion of the holder to the plate during movement of the press to an opened position for insertion of a workpiece into the stamping die.

* * * * *